United States Patent [19]

Martin et al.

[11] Patent Number: 4,844,661

[45] Date of Patent: Jul. 4, 1989

[54] METHOD AND DEVICE FOR DRIVING TOOLS INTO THE GROUND

[75] Inventors: André Martin, Toulon; Minh P. Luong, Montgeron, both of France

[73] Assignee: Technologies Speciales Ingenierie - T.S.I., Toulon, France

[21] Appl. No.: 67,611

[22] Filed: Jun. 26, 1987

[30] Foreign Application Priority Data

Jul. 11, 1986 [FR] France ..... 86 10310

[51] Int. Cl.[4] ..... E02D 7/08

[52] U.S. Cl. ..... 405/232; 173/81; 335/290; 294/65.5; 405/228; 405/303

[58] Field of Search ..... 405/228, 232, 303; 294/65.5; 173/89, 81, 84, 86; 335/290

[56] References Cited

U.S. PATENT DOCUMENTS

| | | | |
|---|---|---|---|
| 841,032 | 1/1907 | Mellgren | 173/84 X |
| 2,091,680 | 8/1937 | Greenlee | 175/293 X |
| 2,224,439 | 12/1940 | Lee | 175/293 X |
| 2,950,088 | 8/1960 | Scott | 175/293 X |
| 3,450,274 | 6/1969 | Johansson | 173/86 X |
| 3,859,571 | 1/1975 | Strobl et al. | 335/290 X |
| 4,059,155 | 11/1977 | Greer | 294/65.5 X |
| 4,154,307 | 5/1979 | Gendron et al. | 405/232 X |
| 4,323,329 | 4/1982 | Chlad | 294/65.5 X |
| 4,378,547 | 3/1983 | Goedhart et al. | 294/65.5 X |

FOREIGN PATENT DOCUMENTS

| | | | |
|---|---|---|---|
| 2205849 | 8/1973 | Fed. Rep. of Germany . | |
| 2507676 | 9/1976 | Fed. Rep. of Germany . | |
| 720127 | 12/1931 | France | 173/81 |
| 2581100 | 10/1986 | France | 405/232 |
| 0094525 | 6/1983 | Japan | 173/89 |

OTHER PUBLICATIONS

Patent Abstracts of Japan, vol. 10, No. 10 (M-446) [2067], Jan. 16, 1986; & JP-A-60 173 217 (Yoshiji Kondou), 06-09-1985.

Patent Abstracts of Japan, vol. 10, No. 105 (M-471) [2162], Apr. 19, 1986; & JP-A-60 238 519 (Kakushin Kogyo K.K.), 27-11-1985.

*Primary Examiner*—Dennis L. Taylor

*Attorney, Agent, or Firm*—Balogh, Osann, Kramer, Dvorak, Genova & Traub

[57] ABSTRACT

This invention relates to a method and device for driving tools into the ground, comprising a chassis in which is slidably mounted an anvil connected by a set of rods to said tool and a hammer sliding in said chassis to strike the anvil, which device further comprises an electro-magnet mounted to slide in said chassis and above said hammer, which is connected to an electrical source as well as to lifting means for gripping the hammer by magnetic attraction after it has dropped on the anvil and to lift the hammer to the upper part of the chassis in order automatically to allow it to drop again by gravity onto said anvil, and in which the hammer comprises in its part opposite the one which comes into contact with the anvil a permanent magnet to increase the force of attraction of the hammer against the electro-magnet, or to create a force of repulsion by change of polarity of the electro-magnet in order to promote separation of the electro-magnet and the hammer and to communicate an initial velocity to said hammer.

10 Claims, 4 Drawing Sheets

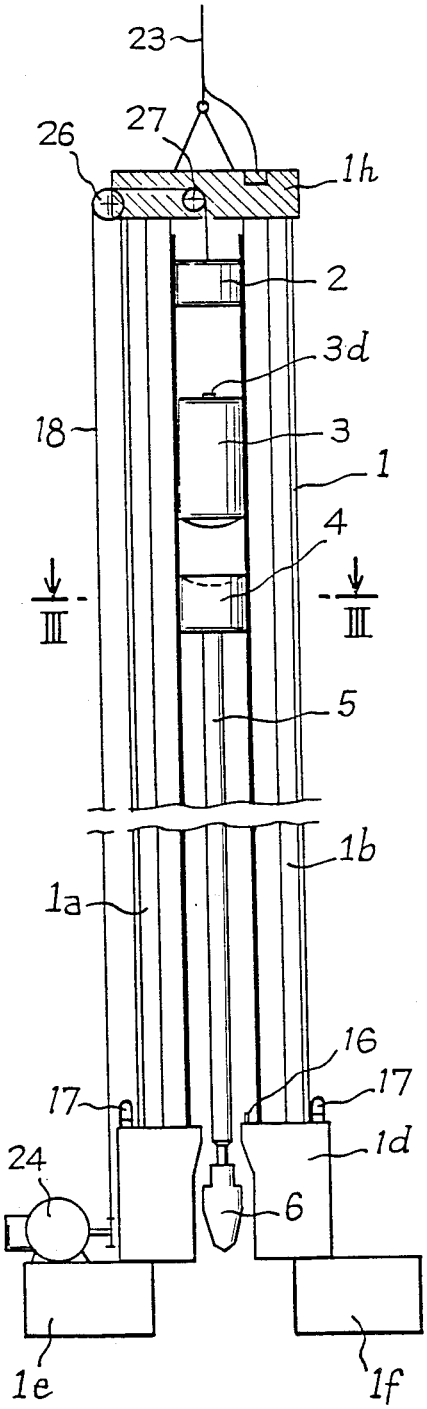
Fig-2
Fig-3
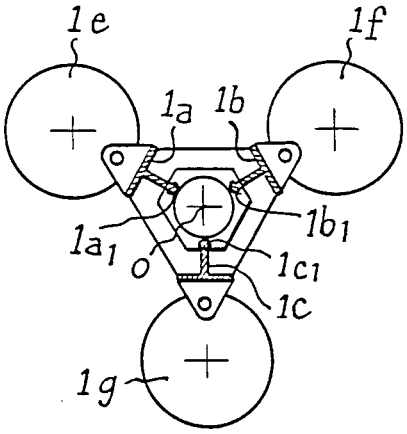

METHOD AND DEVICE FOR DRIVING TOOLS INTO THE GROUND

FIELD OF THE INVENTION

The present invention relates to a method and device for driving tools into the ground.

BACKGROUND OF THE INVENTION

The technical sector of the invention is that of apparatus for driving tools into the ground, for example anchors of piles, measuring tools, coring tools for sampling fragments of soil for analysis or for studying the resistance of the land.

The invention is equally applicable on land, or immersed at shallow or considerable depth.

Known devices of this type are heavy and require large surface means, which renders use thereof very expensive. Hydraulic means, which are generally used for undersea drivers in particular, require the use of a hydraulic power plant and supply cables, which penalize the sea operations due to their heaviness, in addition to the risks of catching, breakage or tangling between the different connections from the surface to the driver.

SUMMARY OF THE INVENTION

It is an object of the invention to overcome these drawbacks.

The object to be attained is a driver for driving tools into the ground, particularly in an aquatic medium and capable of giving information on the surface as to the frequency of the strikes, the progression of penetration of the tool into the ground and the beginning and end of the driving operations.

This object is attained by the method of driving according to the invention, whereby a hammer strikes an anvil connected to a tool for driving said tool into the ground and the hammer is lifted by means of an electro-magnet connected to an electrical source, wherein said hammer is automatically released by inversion of polarity of the electro-magnet when the latter arrives at the end of its top stroke to allow the hammer to drop by gravity onto the anvil.

The object is also attained by the device according to the invention for driving tools into the ground, comprising a chassis in which is slidably mounted an anvil connected by a set of rods to said tool and a hammer sliding in said chassis to strike the anvil, which device further comprises an electro-magnet mounted to slide in said chassis and above said hammer, which is connected to an electrical source as well as to lifting means for gripping the hammer by magnetic attraction after it has dropped onto the anvil and for lifting the hammer to the upper part of the chassis to allow it automatically to drop again by gravity onto said anvil.

The hammer comprises, in its part opposite the one which comes into contact with the anvil, a permanent magnet in order to increase the force of attraction of the hammer against the electro-magnet or to create a force of repulsion by change of polarity of the electro-magnet to promote separation of the electro-magnet and of the hammer and to communicate an initial velocity to said hammer.

Said chassis is composed of a plurality of parallel sections forming a cage in which the electro-magnet, the hammer and the anvil slidably move, which are in contact with the sections by their periphery and are guided by said sections.

In a preferred embodiment, the chassis comprises three T-sections disposed at 120°, of which the webs comprise, along their edge, which is in contact with the electro-magnet, the hammer and the anvil, a coating made of a material promoting slide.

The hammer further comprises, on its periphery, a permanent magnet which cooperates with a magnetic pulse recorder mounted to slide on a rail parallel to the path of the hammer, which recorder is mechanically connected to the anvil in order to move therewith as the tool is driven into the ground under the effect of the hammer.

Said device further comprises means for maintaining the anvil in blocking position when the chassis is placed in position on the site, which means are composed of at least one radial bolt extending inside the cage in which the anvil moves, which is, by gravity, in abutment on said bolt, which is subjected to the effects of an elastic means tending to retract it from said cage with a view to releasing the anvil and cooperates with a trigger connected to a detent member located in the lower end part of the chassis and adapted to come into contact with the ground when the chassis is positioned on the site in order automatically to release the anvil.

In a particular embodiment, the electro-magnet is suspended from a cable wound around a drum connected to an electro-mechanical clutch, itself connected to a gear motor, which drum is connected to an order system comprising an endless screw connected to the shaft of the drum and on which endless screw a cursor moves, and an end of stroke contact located at one of the ends of said screw and on which contact the cursor acts, which contact controls said electromechanical clutch when the electro-magnet is at the end of top stroke in order to initiate disconnection and to allow the electro-magnet to drop by gravity.

Said order system further comprises an end of stroke contact located at the other end of said endless screw and against which contact said cursor acts and which gives the information on end of driving.

In its specific application to the undersea environment, the hammer comprises, in its part which strikes the anvil, a plurality of grooves for waterflow extending from the central part of the hammer up to the periphery thereof.

Said hammer is cylindrical and its end which strikes the anvil is rounded and the contact surface of the hammer on the anvil is a circular surface whose diameter is a third of the diameter of the hammer. Said grooves extend from the edge of this surface to the periphery of the hammer.

In a particular embodiment, the hammer comprises five curved grooves which open out on its periphery at the apices of a regular pentagon.

The anvil comprises conduits which pass right through it and which open out in its upper and lower parts.

In a particular embodiment, the anvil is cylindrical and the face which is struck by the hammer is rounded and concave and comprises a circular contact surface on which the hammer strikes and which corresponds to said circular surface of said hammer. Said conduits open out in the annular zone which extends between said contact surface and the periphery of the anvil.

The driver according to the invention comprises a hammer which, in accordance with the concept of the device, drops freely into the water to strike the anvil without being hindered by steel cables or lines for lifting it again after impact.

Furthermore, the driver, resting on the sea bed, comprises means for informing the surface at any moment as to the state of advance of drive without receiving any order from the surface.

BRIEF DESCRIPTION OF THE DRAWINGS

The invention will be more readily understood on reading the following description with reference to the accompanying drawings in which:

FIG. 2 is a schematic view in section of a device according to the invention in its motorized version which renders it independent.

FIG. 3 is a view in section along line III—III of FIG. 2.

DETAILED DESCRIPTION OF THE DRAWINGS

Figure 1:
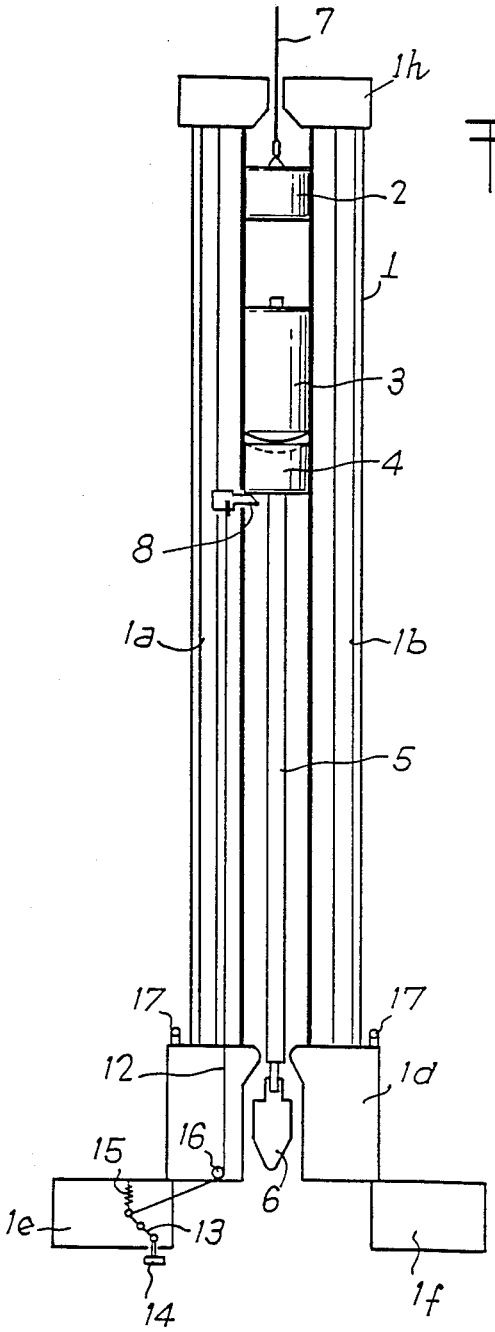
FIG. 1 is a schematic view in section of a device according to the invention, in its version controlled from the surface.

Reference will firstly be made to FIGS. 1 to 3.

The device according to the invention is composed of a chassis 1, forming a cage in which are guidably moved an electro-magnet 2, a hammer 3 and an anvil 4, which is connected by a set of rods 5 to a tool 6.

Said chassis is for example formed by three T-sections 1*a*, 1*b*, 1*c*, disposed at 120° with respect to one another, with the result that the webs of said sections converge on the centre O of the chassis. They define by their free longitudinal edge a transfer channel in which move said electro-magnet 2/hammer 3 and anvil 4, which are cylindrical, are coaxial and of the same diameter, with the result that their periphery is in contact with said edges $1a_1$, $1b_1$, $1c_1$ of the webs of the sections 1*a*, 1*b*, 1*c* of which said edges are coated with a material promoting slide, for example tetrafluoroethylene.

Said sections 1*a*, 1*b*, 1*c* are anchored in the lower part of the chassis 1 in a base 1*d* which rests on three cylindrical supports 1*e*, 1*f*, 1*g* whose function is to improve stability of the driving assembly by lowering by their own weight the centre of gravity of the device and in the upper part, in a rigid structure 1*h*, which serves as stop for the electro-magnet. A damper disposed below the rigid structure 1*h* absorbs part of the end of stroke shock when the electro-magnet rises.

As illustrated in FIG. 1, the driver is lowered onto the bottom by means of an electric cable 7, which, in the embodiment of said Figure, serves to manipulate the electro-magnet 2 which has for its function to raise the hammer 3.

Figure 4:
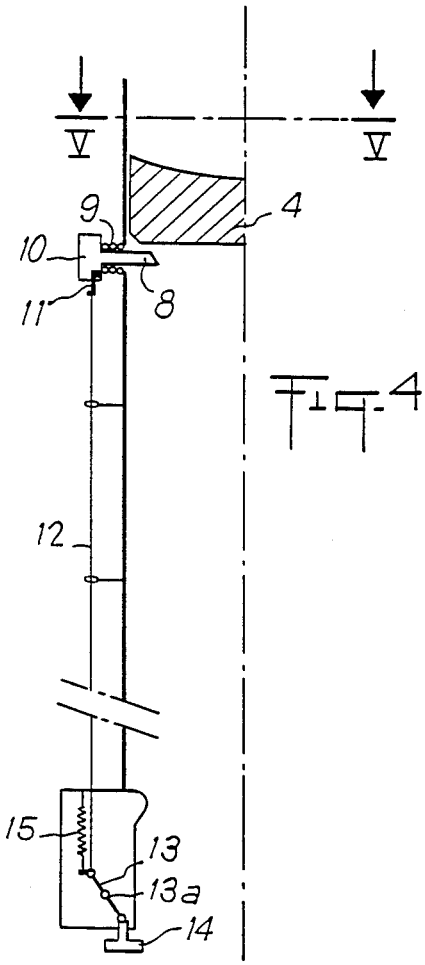
FIG. 4 is a partial schematic view on a larger scale of the control of dropping of the anvil.

When the device descends in the aquatic environment, the anvil 4 is in blocking position in abutment on a bolt 8 which extends radially inside the chassis 1. This bolt 8 is cocked in its extended position as illustrated in FIG. 4 and is subjected to the action of a spring 9 disposed in a casing 10. The bolt 8 cooperates with a trigger 11 connected by a cable or rod 12 to a rocker 13 articulated at its centre at 13*a* and cooperating with a detent 14 which emerges in the lower end part of the chassis 1. A tension spring 15 tends to maintain the detent 14 in extended position. When the chassis is brought into contact with the ground, the detent 14 acts on the trigger 11 by traction of the cable or of rod 12 and the bolt 8 is, under the effect of the compression spring 9, retracted in the casing 10, which provokes unblocking of the anvil which drops by gravity until the tool comes into contact with the ground.

Figure 5:
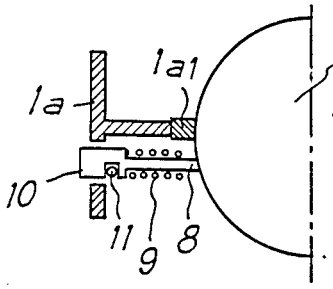
FIG. 5 is a partial schematic view along line V—V of FIG. 4.

In the embodiment of FIG. 1, the trigger 11 is actuated by a cable 12 connected to the detent 14, which emerges beneath one of the supports 1*e* of the chassis, which cable is deviated by an idle pulley 16, mounted about a pin located in the lower part of the base 1*d*. As is schematically shown in FIG. 5, the bolt is mounted in one of the sections 1*a* of the chassis and is parallel to the web of said section.

When the chassis descends to the sea-bed, the hammer 3 is in abutment on the anvil 4. An end of stroke stop 16 (FIG. 2), disposed in the lower part of the cage in which the anvil moves has for its function to warn the surface as to the end of driving. In its lower part, the chassis also comprises acoustic markers 17 to warn the surface that the driver is indeed resting on the sea-bed. A device measuring inclination (not shown) gives the verticality of the frame.

Figure 8:
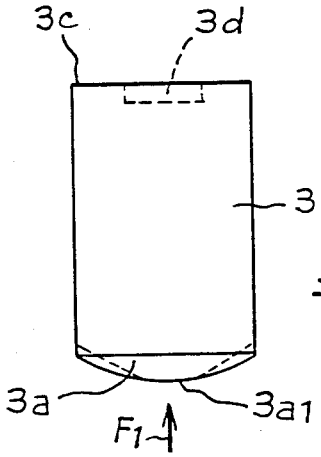
FIG. 8 is a view in elevation of a hammer equipping the driver according to the invention.
Figure 10:
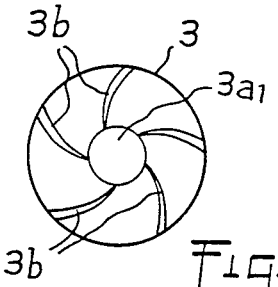
FIG. 10 is a view in the direction of arrow $F_1$ of the concave end of the hammer of FIG. 8.
Figure 9:
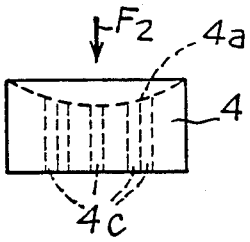
FIG. 9 is a view in elevation of an anvil adapted to cooperate with the hammer of FIG. 8.
Figure 11:
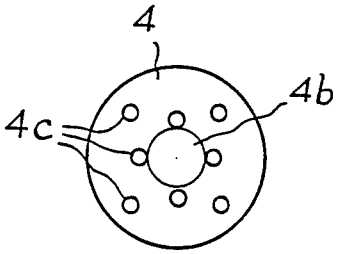
FIG. 11 is a view in the direction of arrow $F_2$ of the concave incurved part of the anvil of FIG. 9.

The hammer 3 (FIGS. 8 and 10) is constituted by a cylindrical steel mass rounded at its end 3*a* which comes into contact with the anvil 4, which part comprises a contact surface $3a_1$ adapted to strike the anvil 4. This contact surface is preferably circular and its diameter is a third of the diameter of the hammer.

In the annular zone included between said surface $3a_1$ and its periphery, the hammer 3 comprises a plurality of grooves 3*b*, for example five in number, which grooves are curved and open out on the periphery of the hammer at the apices of a regular pentagon to ensure flow of the water upon contact between hammer and anvil.

The anvil 4 is cylindrical, of the same diameter as the hammer 3 and its part 4*a*, which is struck by the hammer, is incurved and concave. It comprises a contact surface 4*b* which corresponds to the contact surface $3a_1$ of the hammer and the annular zone included between the surface 4*b* and the periphery of the anvil comprises a plurality of conduits 4*c* which pass right through the anvil lengthwise and which open out in its lower and upper parts. The function of conduits 4*c* is to ensure flow of the water through the anvil when the hammer 3 strikes anvil 4.

In the principle of this driver, the hammer 3 must never attain its limiting velocity in order to avoid turbulences inherent in the drag. The velocity of the hammer 3 to within the frictions is the fruit of gravity $V=\sqrt{2gh}$.

Due to its weight and size, the device of the invention may be employed by a relatively small surface support. For example, the driver intended to drive an ocean anchor with a resistance of 100 tons, weighs only 4.5 tons in air for a height of twelve meters and a ground width at the base of 2.5 meters (maximum dimensions).

Friction of the electro-magnet 2 of the anvil 4 and of the hammer 3 is minimized by the fact that the edges of the webs of the sections 1*a*, 1*b*, 1*c* of which the chassis is composed and which guide said elements are coated with a coating of tetrafluoroethylene.

The hammer 3 may comprise on its periphery two tetrafluoroethylene belts in order to ensure better magnetic insulation and considerably to reduce frictions further.

In its part 3*c* opposite the convex part 3*a*, the hammer 3 (FIG. 8) comprises at its centre a permanent magnet 3*d* which is embedded in the mass of the hammer. This magnet is opposite the electromagnet 2 and has a double function:

that of increasing the field of attraction of the electromagnet when the hammer 3 is gripped after it has struck the anvil 4;

of creating a repellent field to promote separation of the electro-magnet 2 and of the hammer 3 by inversion of polarity of the electro-magnet.

Figure 6:
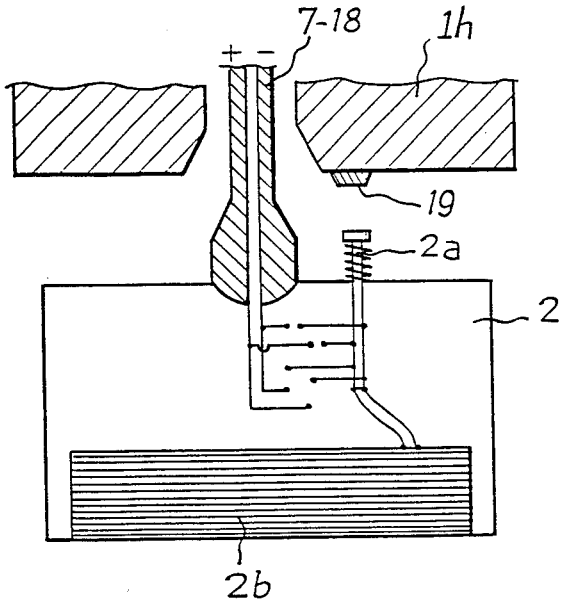
FIG. 6 is a schematic view showing the working principle of the polarity inverter of the electro-magnet with the device according to the invention is equipped.
Figure 12:
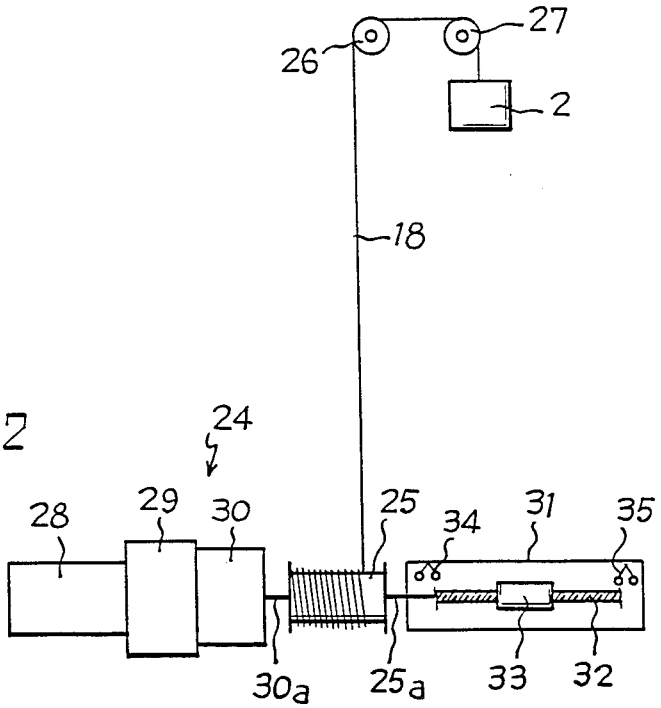
FIG. 12 is a schematic view of the motorization of the device according to the invention in its independent version.

Such inversion of polarity (FIG. 6) is effected automatically when the electro-magnet comes into abutment on the structure 1*h* of the chassis 1.

The electro-magnet is supported by an electric cable 7, 18 (FIGS. 1 and 2). The electro-magnet is cylindrical and comprises in its upper part an end of stroke contact 2*a* connected to the turns 2*b* of the electro-coil and performing the function of polarity inverter. When the contactor is outspread in the position illustrated in FIG. 6, the electro-magnet is in position of attractive field and retains hammer 3 until the latter is raised to the upper part of the chassis. As soon as the contactor 2*a* encounters stop 19, fixed below the structure 1*h*, the polarity is inverted and the electro-magnet is placed in position of repellent field, which, taking into account the polar opposition of the permanent magnet 3*d* of the hammer, causes sudden separation of the electro-magnet 2 and hammer 3, which is propelled and then drops by gravity onto the anvil 4.

Figure 7:
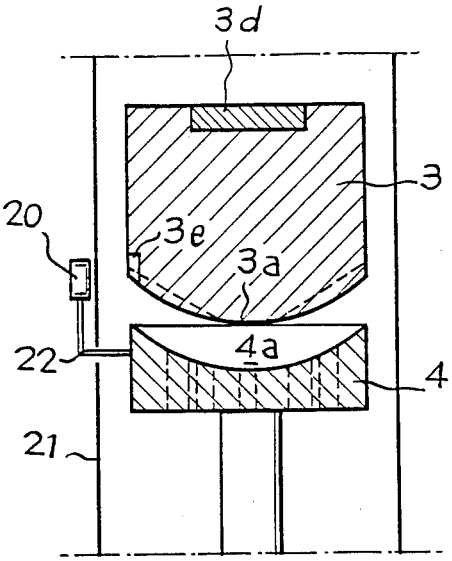
FIG. 7 is a schematic view in section of the hammer and the anvil with which the driver according to the invention is equipped, illustrating the means for recording the velocity and frequency of striking by magnetic impulsion.

Reference will now be made to FIG. 7 of the drawings. The hammer 3 which is guided in rotation about its axis of revolution comprises on its part 3*a* side, another permanent magnet 3*e* which cooperates with a magnetic pulse recorder 20, mounted to slide on a rail 21, parallel to he sections 1*a*, 1*b*, 1*c* of the chassis 1 and thus to the path of the hammer 3, which recorder 20 is mechanically connected to the anvil 4 by a flexible dielectric link 22 for example made of tetrafluoroethylene, to move with the anvil 4 as the tool is driven into the ground under the effect of the hammer 3.

Said recorder 20 counts the strikes and velocity of the hammer and makes it possible at any moment to know the quantity of kinetic energy employed, this notion of quantifiable energy allowing a reasonable forecast, for example with a view to anchoring by an ocean anchor.

Such quantification of energy also makes it possible to determine the nature of the ground.

The driver according to the invention finds its application for all types of homogeneous or heterogeneous ground of which the simple compressive strength may go up to 250 bars.

Reference will again be made to FIG. 2 of the drawings, which shows a driver according to the invention in its independent version. The driver is handled by an electric cable 23. The electro-magnet 2 is actuated by a gear-motor unit 24 fixed to one of the supports 1*e* of the chassis. The electro-magnet is suspended from cable 18 wound about a drum 25 driven by said unit 24 and which is supported by two pulleys 26, 27 located in the upper part of the chassis 1.

Unit 24 is composed of a motor 28, a reduction gear 29 and a clutch 30. The drum 25 is fitted on the driven shaft 30*a* of the clutch 30. The length of the cable 18 is equivalent to the maximum penetration of the set of rods 5.

The drum 25 is connected to an order system 31. The shaft 25*a* of the drum 25 is extended by an endless screw 32 on which a cursor 33 moves. The order system comprises at one end of the screw 32 and on drum 25 side, an end of stroke contact 34 on which said cursor 33 acts. The contact 34 controls clutch 30 which is of the electro-mechanical type, when the electro-magnet 2 is at the end of top stroke against the structure 1*h* in order to initiate disconnection and allow the electro-magnet to drop by gravity.

The order system 31 comprises a second end of stroke contact 35, located at the other end of the endless screw 32 and against which contact the cursor 33 acts at the end of driving.

The information given by the contact 35 is communicated to the surface control station.

The order system 31 is timed at 0.1 second after release of the electro-magnet by inversion of polarity, as seen above, to allow the hammer 3 to take a lead in its drop.

The order system 31 controls disconnection of the drum 25 when the electro-magnet 2 comes into abutment on the structure 1*h* in the upper part of the frame. The electro-magnet 2 drops by gravity towards the hammer 3 which strikes the anvil 4 and takes it by magnetic attraction. The drum 25 unwinds by the necessary cable length.

A timing controls the clutch to raise the electro-magnet and the hammer to the upper part of the chassis 1.

The operation is renewed as the tool is driven into the ground.

When the drum 25 is completely unwound, the cursor 33 of the order system actuates the end of stroke contact 35 which informs the control station on the surface that the tool is driven to the required depth.

This signal terminates the driving operations and the driver is hauled by cable 23 on the surface support.

Of course, the different components of the driver, such as motor gear/clutch/transformer/order systems, are placed in water-tight enclosures in order to withstand the pressures on the sea-bed.

What is claimed is:

1. A device for driving tools into the ground, comprising a chassis in which is slidably mounted an anvil connected by a set of rods to said tool and a hammer sliding in said chassis to strike the anvil, wherein said device further comprises an electro-magnet mounted to slide in said chassis and above said hammer, which is connected to an electrical source as well as to lifting means for gripping the hammer by magnetic attraction after it has dropped onto the anvil and for lifting the hammer to the upper part of the chassis to allow it automatically to drop again by gravity onto said anvil, wherein said chassis is composed of a plurality of parallel sections forming a cage in which the electro-magnet, the hammer and the anvil slidably move, which are in contact with the sections by their periphery and are guided by said sections, wherein the chassis comprises three T-sections disposed at 120°, of which the webs comprise, along their edge, which is in contact with the electro-magnet, the hammer and the anvil, a coating made of a material promoting slide, wherein the hammer further comprises, on its periphery, a permanent magnet which cooperates with a magnetic pulse recorder mounted to slide on a rail parallel to the path of the hammer, which recorder is mechanically connected to the anvil in order to move therewith as the tool is driven into the ground under the effect of the hammer.

2. The device of claim 1, wherein said hammer comprises, in its part opposite the one which comes into contact with the anvil, a permanent magnet in order to increase the force of attraction of the hammer against the electro-magnet or to create a force of repulsion by change of polarity of the electro-magnet to promote separation of the electro-magnet and of the hammer and to communicate an initial velocity to said hammer.

3. The device of claim 1, wherein it comprises means for maintaining the anvil in blocking position when the chassis is placed in position on the site, which means are composed of at least one radial bolt extending inside the cage in which the anvil moves, which is, by gravity, in abutment on said bolt, which is subjected to the effects of an elastic means tending to retract it from said cage with a view to releasing the anvil and cooperates with a trigger connected to a detent member located in the lower end part of the chassis and adapted to come into contact with the ground when the chassis is positioned on the site in order automatically to release the anvil.

4. The device of claim 1, wherein the electro-magnet is suspended from a cable wound around a drum connected to an electro-mechanical clutch, itself connected to a gear motor, which drum is connected to an order system comprising an endless screw connected to the shaft of the drum and on which endless screw a cursor moves, and an end of stroke contact located at one of the ends of said screw and on which contact the cursor acts, which contact controls said electromechanical clutch when the electro-magnet is at the end of top stroke in order to initiate disconnection and to allow the electro-magnet to drop by gravity.

5. The device of claim 4, wherein said order system further comprises an end of stroke contact located at the other end of said endless screw and against which contact said cursor acts and which gives the information on end of driving.

6. The device of claim 5, in its application to the undersea environment, wherein the hammer comprises, in its part which strikes the anvil, a plurality of grooves for water-flow extending from the central part of the hammer up to the periphery thereof.

7. The device of claim 6, of which the hammer is cylindrical, wherein the end which strikes the anvil is rounded and the contact surface of the hammer on the anvil is a circular surface whose diameter is a third of the diameter of the hammer, and said grooves extend from the edge of this surface to the periphery of the hammer.

8. The device of claim 7, wherein the hammer comprises five curved grooves which open out on its periphery at the apices of a regular pentagon.

9. The device of claim 8, wherein the anvil comprises conduits which pass right through it and which open out in its upper and lower parts.

10. The device of claim 9, of which the anvil is cylindrical, wherein the face which is struck by the hammer is rounded and concave and comprises a circular contact surface on which the hammer strikes and which corresponds to said circular surface of said hammer, and said conduits open out in the annular zone which extends between said contact surface and the periphery of the anvil.

* * * * *